US007966675B2

(12) United States Patent
Matejka

(10) Patent No.: US 7,966,675 B2
(45) Date of Patent: Jun. 28, 2011

(54) DUMPSTER AND PORTABLE TOILET SYSTEM

(76) Inventor: Jeffrey Matejka, Trempealeau, WI (US)

( * ) Notice: Subject to any disclaimer, the term of this patent is extended or adjusted under 35 U.S.C. 154(b) by 1136 days.

(21) Appl. No.: 11/687,656

(22) Filed: Mar. 18, 2007

(65) Prior Publication Data

US 2007/0214565 A1 Sep. 20, 2007

Related U.S. Application Data

(60) Provisional application No. 60/743,548, filed on Mar. 17, 2006.

(51) Int. Cl.
*E03D 9/02* (2006.01)

(52) U.S. Cl. ..... 4/300; 4/449

(58) Field of Classification Search ..... 4/300, 449, 4/458, 460
See application file for complete search history.

(56) References Cited

U.S. PATENT DOCUMENTS 4,615,810 A * 10/1986 Conner ..... 405/129.3
5,183,293 A * 2/1993 Julian ..... 280/430

* cited by examiner

*Primary Examiner* — Huyen Le
(74) *Attorney, Agent, or Firm* — Dicke, Billig & Czaja, PLLC

(57) ABSTRACT

A combination dumpster and portable toilet system is disclosed and described. The housing provides an enclosure for collection of refuse. The housing also provides for secure stowage of portable toilets to and from a worksite, as well as protection of the portable toilets from falling debris, theft and vandalism.

20 Claims, 4 Drawing Sheets

DUMPSTER AND PORTABLE TOILET SYSTEM

REFERENCE TO RELATED APPLICATION

This application claims priority to U.S. Applic. No. 60/743,548, filed Mar. 17, 2006, the content of which is incorporated herein by reference.

FIELD OF THE INVENTION

The invention relates generally to a waste collection system. More particularly, the invention relates to a combination dumpster and portable toilet.

BACKGROUND OF THE INVENTION

When performing various construction projects, it is necessary to remove rubbish that is generated during the construction project. One typical way of collecting and removing rubbish is using an elongated dumpster having an open top.

The dumpster is delivered to the area where the construction project is being done on a truck. The dumpster is then rolled off the truck and placed on the ground. Once the dumpster is filled with rubbish, the dumpster is rolled onto the truck and taken away for disposal.

When performing construction projects, it is typically not possible to use the plumbing facilities. As it is often necessary for workers to use a toilet while working, portable toilets are often delivered to the work site.

SUMMARY OF THE INVENTION

Various embodiments of the invention provide a housing for stowage of portable toilets that is integral to a dumpster unit. The arrangement provides for ready transportation of the portable toilets, protects the toilets from falling debris at a worksite, and provides a means for securing the toilets from theft or vandalism when the worksite is unattended.

DETAILED DESCRIPTION OF THE PREFERRED EMBODIMENTS

Figure 1:
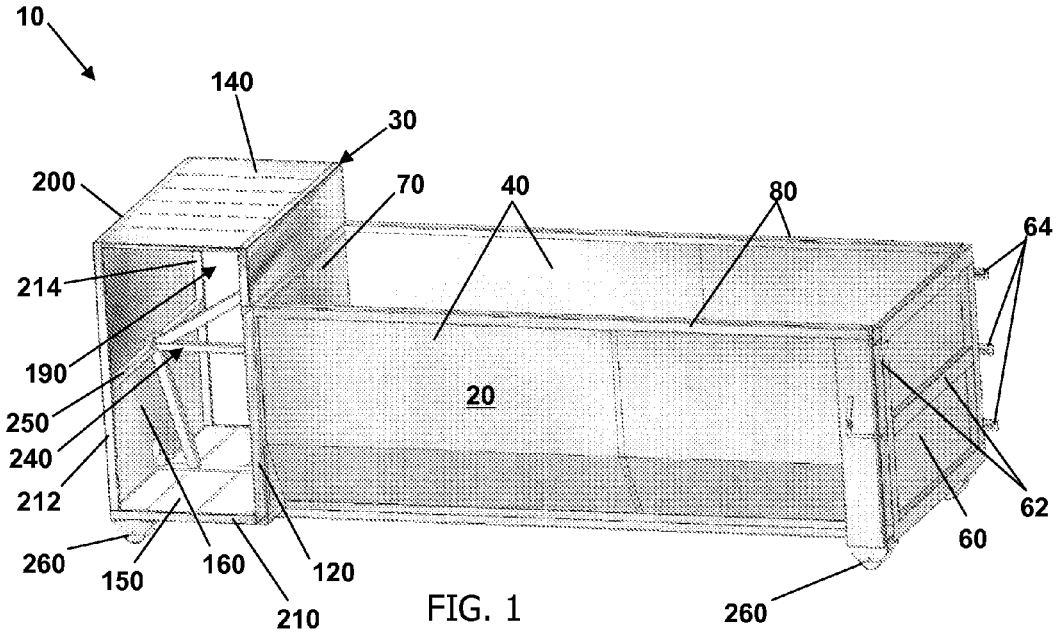
FIG. 1 is a perspective view of a dumpster and portable toilet system according to an embodiment of the invention.
Figure 2:
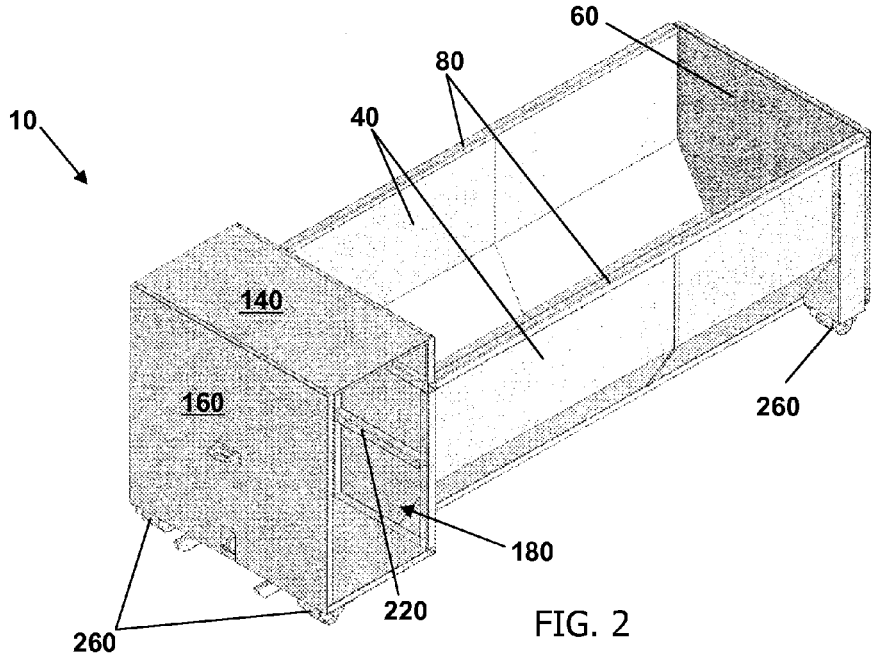
FIG. 2 is another perspective view of the dumpster and portable toilet system.
Figure 3:
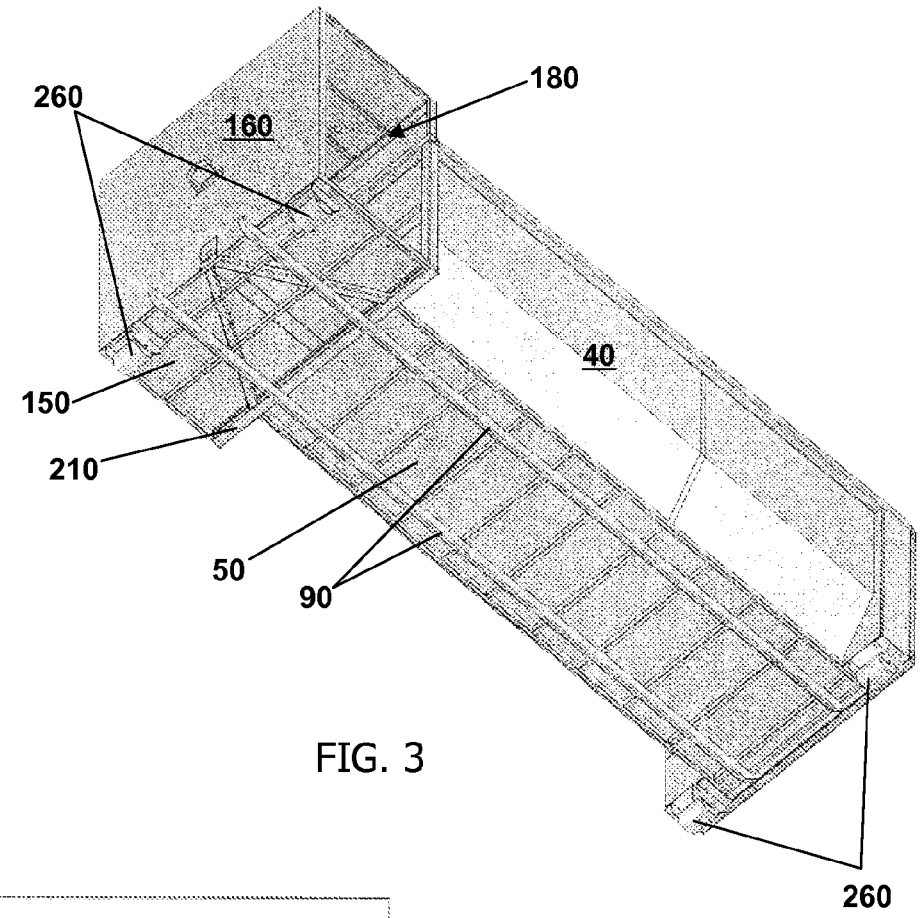
FIG. 3 is a bottom perspective view of the dumpster and portable toilet system.
Figure 4:
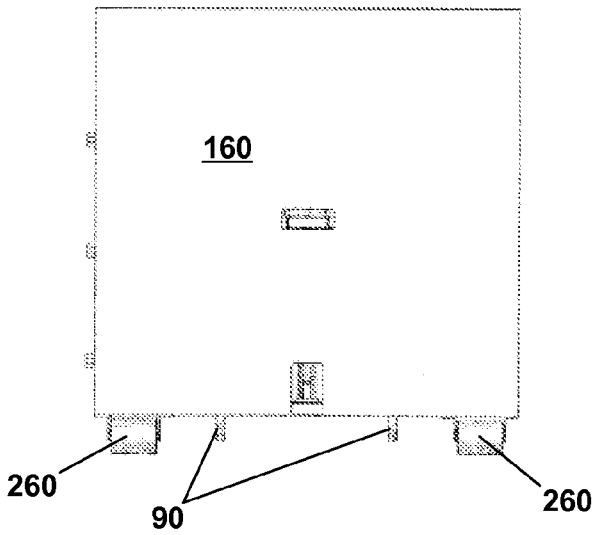
FIG. 4 is a front view of the dumpster and portable toilet system.
Figure 5:
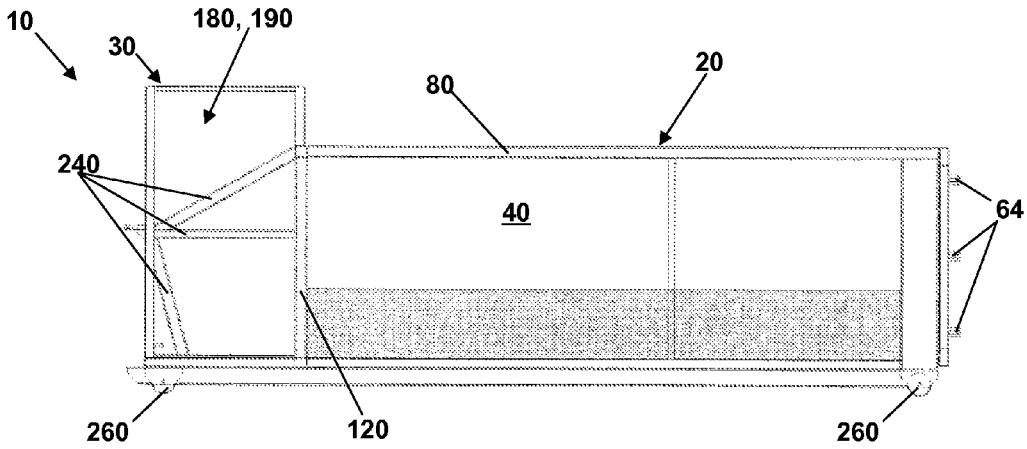
FIG. 5 is a side view of the dumpster and portable toilet system.
Figure 6:
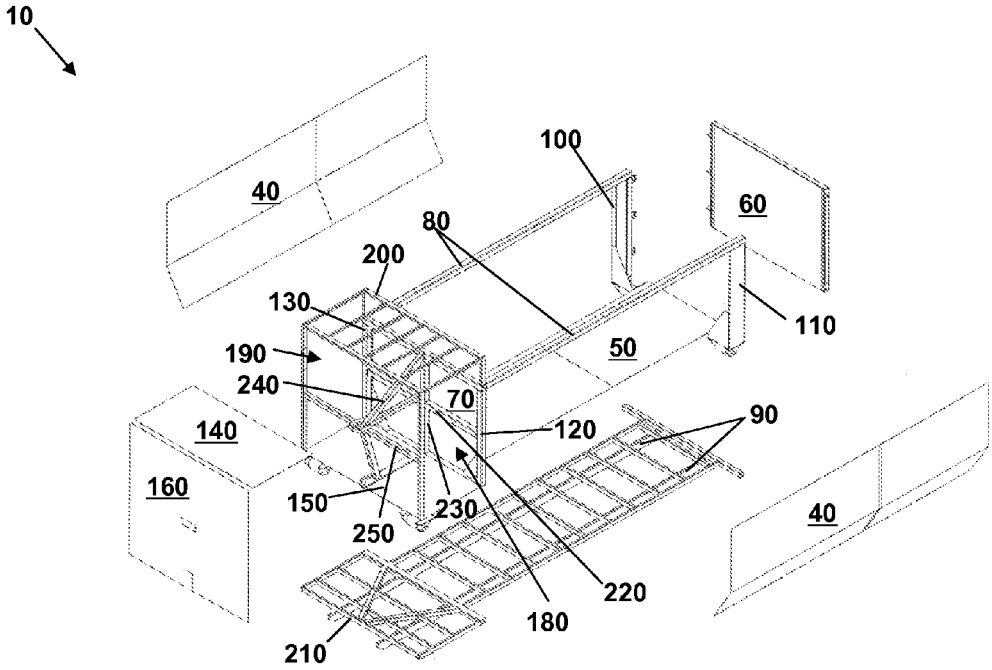
FIG. 6 is an exploded perspective view of the dumpster and portable toilet system.

An embodiment of the invention is directed to a dumpster and portable toilet system, as illustrated at 10 in the figures. The dumpster and portable toilet system 10 generally includes a dumpster portion 20 and a toilet housing portion 30.

In some configurations, the dumpster portion 20 has a capacity of about 10 yards, 20 yards or 30 yards. The dumpster portion 20 includes side panels 40, a bottom panel 50, a free end panel 60, and a common end panel 70, framed on the upper edges 80, on the bottom by a chassis 90, and on the four corners 100, 110, 120 and 130. The common end panel 70 is so named because it forms a common wall between the dumpster portion 20 and the toilet housing portion 30.

The free end panel 60 may be supported by a separate frame work 62 and mounted on hinges 64 to allow the panel to swing away from the end of the dumpster portion 20 to facilitate loading and unloading.

The toilet housing portion 30 is bounded by a top panel 140, a bottom panel 150, the aforementioned common end panel 70 and a side panel 160, with ends 180 and 190 remaining open for toilet access. The panels of the toilet housing portion 30 are held together with an upper framework 200, a lower framework 210, corner posts 212 and 214, and the corners 120 and 130 that support the common end panel 70. The common end panel 70 is also supported and reinforced by a cross member 220 that extends between corners 120 and 130, and a center post 230. Alternatively, the toilet housing portion 30 may be fabricated without the panels covering the framework.

A support structure 240 depends from cross member 220 and the center post 230 to give the toilet housing 30 rigidity. The support structure 240 spans the interior of the toilet housing and is connected to a cross member 250. The support structure also serves to divide the toilet housing portion 30 effectively into two compartments.

In another embodiment (not shown), the ends 180 and 190 could be enclosed, with side 160 being left open for toilet access. Such an arrangement would require substitution of the cross member 250 with a vertical post (not shown) that extends from the chassis 90 to an upper member of the framework 200.

The chassis 90 is common to both the dumpster portion 20 and the toilet housing portion 30. The dumpster and portable toilet system 10 may be equipped with rollers or casters 260 to aid in the positioning and movement of the dumpster and portable toilet system 10.

Portable toilets contained within the toilet housing portion 30 can be secured by locking a chain around the toilet housing portion 30, thereby preventing their removal from the toilet housing. Alternatively, the toilet housing portion 30 can be equipped with lock bars (not shown) that span the ends 180 and 190 and are detachably locked to the toilet housing portion 30.

As an alternative to forming the portable toilet separate from the other components of the dumpster and portable toilet system 10, it is possible that the portable toilet may be integrally fabricated as part of the dumpster and portable toilet system 10.

Figure 7:
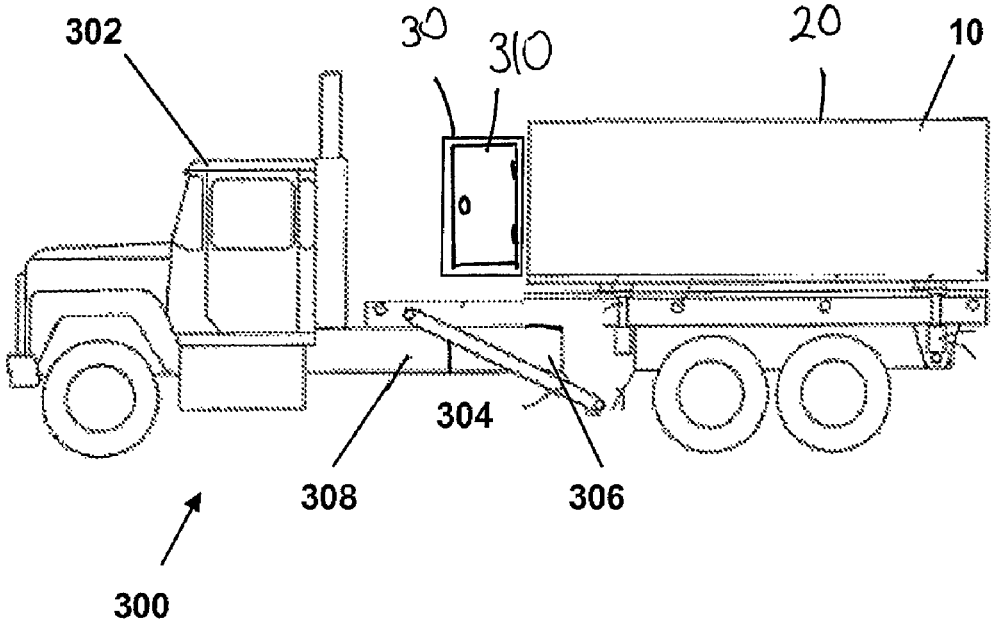
FIG. 7 is a side view of construction site maintenance system according to an embodiment of the invention.

The invention is also directed to a construction site maintenance system 300 that includes a transportation vehicle 302 on which the dumpster and portable toilet system 10 may be removably placed, as illustrated in FIG. 7. The toilet housing portion 30 is adapted to receive a portable toilet 310. In one configuration, the transportation vehicle 302 may be a conventional truck. Alternatively, the transportation vehicle 302 may be a trailer.

The dumpster and portable toilet system 10 may be placed onto and removed from the transportation vehicle 302 using a sliding motion with a hoist mechanism 304. There are a variety of hoist mechanisms 304 for placing the dumpster and portable toilet system 10 onto the transportation vehicle 302 such as a cable and a hook.

The transportation vehicle 302 may also include equipment to service the portable toilet such as a fresh liquid tank 306, a waste collection tank 308, a fresh liquid pump system to deliver fresh liquid to the portable toilet and a waste pump system to remove waste from the portable toilet.

Alternatively, fresh liquid may be placed in the portable toilet before delivery of the dumpster and portable toilet system to the use location and waste can be removed from the portable toilet after the dumpster and portable toilet system is retrieved from the use location. In this configuration, a lid or sealing device may be provided in the portable toilet to prevent fresh liquid and waste from spilling from the portable toilet as the dumpster and portable toilet system is being placed onto and removed from the transportation vehicle 302 as well as while the transportation vehicle is moving to the use location.

In operation, the dumpster and portable toilet system 10 is placed on the transportation vehicle 302 and delivered to the use location. While it is possible to place the portable toilet in the dumpster and portable toilet system 10 after delivery to the use location, the portable toilet is preferably placed in the dumpster and portable toilet system 10 prior to delivery to the use location.

Once at the use location, the dumpster and portable toilet system 10 is moved off of the transportation vehicle 302 using the hoist mechanism 304. The fresh liquid pump system is used to place fresh liquid in the portable toilet.

The dumpster and portable toilet system 10 is then used by placing refuse in the dumpster portion 20 and using the portable toilet for collection of bodily excrements such as urination and defecation. When done using the dumpster and portable toilet system 10, the transportation vehicle 302 returns to the use location.

Prior to placing on the dumpster and portable toilet system 10 on the transportation vehicle 302 with the hoist mechanism 304, the waste pump may be used to remove waste from the portable toilet. Alternatively, if the portable toilet needs service prior to filling of the dumpster portion 20 with refuse, the waster pump may be used for remove waste from the portable toilet and then the fresh liquid pump may be used to place fresh liquid into the portable toilet.

While the particular embodiments presented and described in detail above are exemplary of the invention, it is to be understood that they are merely illustrative. Various other modifications and changes with which the invention can be practiced and which are within the scope of the description provided herein will be readily apparent to those of ordinary skill in the art.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A waste removal system comprising:
a dumpster and portable toilet system comprising:
a chassis;
a dumpster portion attached to the chassis, wherein the dumpster portion has an enclosure that is adapted for receiving refuse; and
a toilet housing portion attached to the chassis, wherein the toilet housing portion has a recess formed therein that is adapted to receive a portable toilet; and
a transportation vehicle comprising a hoist mechanism for placing the dumpster and portable toilet system onto the transportation vehicle and moving the dumpster and portable toilet system off of the transportation vehicle.

2. The waste removal system of claim 1, wherein the chassis further comprises rollers or casters mounted thereto for positioning or moving the dumpster and portable toilet system.

3. The waste removal system of claim 1, wherein the dumpster portion comprises a pair of side panels, a bottom panel, a free end panel, and a common end panel that are attached together to form the enclosure and wherein at least the free end panel is pivotally attached to the dumpster portion.

4. The waste removal system of claim 1, wherein the toilet housing portion comprises a frame.

5. The waste removal system of claim 4, wherein the toilet housing portion further comprises panels that substantially cover the frame.

6. The waste removal system of claim 1, and further comprising a locking mechanism to retain the portable toilet in the toilet housing portion.

7. The waste removal system of claim 1, wherein the portable toilet is removable mounted in the toilet housing portion or integrally fabricated in the toilet housing portion.

8. A waste removal system comprising:
a portable toilet comprising a toilet, a waste collection tank and an enclosure;
a dumpster and portable toilet system comprising:
a chassis:
a dumpster portion attached to the chassis, wherein the dumpster portion has an enclosure that is adapted for receiving refuse; and
a toilet housing portion attached to the chasses, wherein the toilet housing portion has a recess formed therein that is adapted to receive the portable toilet; and
a transportation vehicle on which the dumpster and portable toilet system may be placed, wherein the transportation vehicle comprises a hoist mechanism for placing the dumpster and portable toilet system onto the transportation vehicle and moving the dumpster and portable toilet system off of the transportation vehicle.

9. The waste removal system of claim 8, wherein the chassis further comprises rollers or casters mounted thereto for positioning or moving the dumpster and portable toilet system.

10. The waste removal system of claim 8, wherein the dumpster portion comprises a pair of side panels, a bottom panel, a free end panel, and a common end panel that are attached together to form the enclosure and wherein at least the free end panel is pivotally attached to the dumpster portion.

11. The waste removal system of claim 8, wherein the toilet housing portion comprises a frame.

12. The waste removal system of claim 11, wherein the toilet housing portion further comprises panels that substantially cover the frame.

13. The waste removal system of claim 8, and further comprising a locking mechanism to retain the portable toilet in the toilet housing portion.

14. The waste removal system of claim 8, wherein the portable toilet is removably mounted in the toilet housing portion or integrally fabricated in the toilet housing portion.

15. The waste removal system of claim 8, wherein the hoist mechanism slides the dumpster and portable toilet system onto and off of the transportation vehicle.

16. The waste removal system of claim 8, wherein the transportation vehicle further comprises a portable toilet servicing system that comprises a fresh liquid storage tank, a fresh liquid pumping system, a waste storage tank and a waste pumping system.

17. The waste removal system of claim 8, wherein the hoist mechanism slides the dumpster and portable toilet system onto and off of the transportation vehicle.

18. A method of removing waste comprising:

providing a dumpster and portable toilet system comprising a chassis, a dumpster portion and a toilet housing portion, wherein the dumpster portion and toilet housing portion are attached to the chassis, wherein the dumpster portion has an enclosure that is adapted for receiving refuse;

providing a transportation vehicle comprising a hoist mechanism;

delivering the dumpster to a use location with the transportation vehicle;

moving the dumpster and portable toilet system off of the transportation vehicle with the hoist mechanism;

positioning a portable toilet in the toilet housing portion, wherein the portable toilet comprises a toilet, a waste collection tank and an enclosure;

placing refuse in the dumpster portion;

collection bodily excrements in the portable toilet; and moving the dumpster and portable toilet system onto the transportation vehicle with the hoist mechanism.

19. The method of claim 18, and further comprising:

delivering fresh liquid from a fresh liquid storage tank attached to the transportation vehicle to the portable toilet using a fresh liquid pumping system; and removing waste from the portable using a waste pumping system and delivering the waste to a waste storage tank attached to the transportation vehicle.

20. The method of claim 18, wherein the portable toilet is integrally fabricated with the toilet housing portion.

* * * * *